United States Patent [19]

Kapuscinski et al.

[11] Patent Number: 5,021,177

[45] Date of Patent: Jun. 4, 1991

[54] DISPERSANT-ANTIOXIDANT MULTIFUNCTIONAL VISCOSITY INDEX IMPROVER

[75] Inventors: Maria M. Kapuscinski, Carmel, N.Y.; Thomas F. Derosa, Passaic, N.J.; Robert T. Biggs, Walden; Theodore E. Nalesnik, Wappinger Falls, both of N.Y.

[73] Assignee: Texaco Inc., White Plains, N.Y.

[21] Appl. No.: 513,374

[22] Filed: Apr. 23, 1990

[51] Int. Cl.[5] ..... C10M 149/04

[52] U.S. Cl. ..... 252/51.5 R; 525/131; 525/331.7

[58] Field of Search ..... 252/515 R; 525/131, 525/331.7

[56] References Cited

U.S. PATENT DOCUMENTS

| | | | |
|---|---|---|---|
| 3,687,905 | 8/1972 | Dorer | 525/331.7 |
| 4,051,050 | 9/1977 | Elliott et al. | 252/515 R |
| 4,292,185 | 9/1981 | Bollinger | 525/131 |
| 4,316,967 | 2/1982 | Hergenrother et al. | 525/111 |
| 4,557,847 | 12/1985 | Gutierrez et al. | 252/515 A |
| 4,764,304 | 8/1988 | Kapuscinski et al. | 252/51.5 R |

*Primary Examiner*—Prince E. Willis
*Assistant Examiner*—Ellen McAvoy
*Attorney, Agent, or Firm*—Robert A. Kulason; James J. O'Loughlin; Vincent A. Mallare

[57] ABSTRACT

Dispersant viscosity index improvers for lubricating oils contain an EPR or EPT polymer onto which has been graft polymerized with isocyanatoethyl methacrylate and thereafter reacted with N-phenyl-p-phenylene diamine.

16 Claims, No Drawings

DISPERSANT-ANTIOXIDANT MULTIFUNCTIONAL VISCOSITY INDEX IMPROVER

BACKGROUND OF THE INVENTION

This invention relates to a novel multi-functional lubricant additive which is a dispersant, anti-oxidant and a V.I. improver (VIP) additive when employed in a lubricating oil composition.

It is well known to those skilled in the art, that hydrocarbon lubricating oils must be formulated by addition of various additives to improve their properties.

In the case of lubricating oils, typified by those employed in railway, automotive, aircraft, marine etc., service, it is found that they become degraded during use due inter alia to formation of sludge which may be generated by deterioration of the oil or by introduction of undesirable components from other sources including the fuel or the combustion air. In order to maintain and improve the properties of the lubricating oil, various additives have heretofore been provided; and these have been intended to improve the viscosity index, dispersancy, oxidative stability, etc.

It is, therefore, an object of this invention to provide an additive system which imparts to lubricating oils these improved properties of viscosity index, dispersancy, oxidative stability, etc. Other objects will be apparent to those skilled in the art.

DISCLOSURE STATEMENT

The art contains many teachings on the use of polymer additives in lubricating oil compositions. Ethylene-propylene copolymers and ethylene-alpha olefin non-conjugated diene terpolymers which have been further derivatized to provide bifunctional properties in lubricating oil compositions illustrate this polymer type of oil additive.

U.S. Pat. No. 3,522,180 discloses a method for the preparation of an ethylene-propylene copolymer substrate effective as a viscosity index improver for lubricating oils.

U.S Pat. No. 4,089,794 discloses ethylene copolymers derived from ethylene and one of more ($C_3$ to $C_{28}$) alpha olefin solution grafted with an ethylenically-unsaturated carboxylic acid material followed by a reaction with a polyfunctional material reactive with carboxyl groups, such as a polyamine, a polyol, or a hydroxylamine which reaction product is useful as a sludge and varnish control additive in lubricating oils.

U.S. Pat. No. 4,137,185 discloses a stabilized imide graft of an ethylene copolymer additive for lubricants.

U.S. Pat. No. 4,146,489 discloses a graft copolymer where the backbone polymer is an oil-soluble ethylene-propylene copolymer or an ethylene-propylene-diene modified terpolymer with a graph monomer of C-vinylpyridine or N-vinylpyrrolidone to provide a dispersant VI improver for lubricating oils.

U.S. Pat. No. 4,320,019 discloses a multipurpose lubricating additive prepared by the reaction of an interpolymer of ethylene and a ($C_3$–$C_8$) alpha-monoolefin with an olefinic carboxylic acid acylating agent to form an acylating reaction intermediate which is then reacted with an amine.

U.S. Pat. No. 4,764,304 discloses a lubricating oil dispersant VI improver composition containing an additive prepared by the reaction of an olefin copolymer and an unsaturated isocyanate to form reactive intermediate which is then reacted with heterocyclic amines.

U.S. Pat. No. 4,340,689 discloses a process for grafting a functional organic group onto an ethylene copolymer or an ethylene-propylene-diene terpolymer.

U.S. Pat. No. 4,357,250 discloses a reaction product of a copolymer and an olefin carboxylic acid via the "ene" reaction followed by a reaction with a monoamine-polyamine mixture.

U.S. Pat. No. 4,382,007 discloses a dispersant—VI improver prepared by reacting a polyamine-derived dispersant with an oxidized ethylene-propylene polymer or an ethylene-propylene diene terpolymer.

U.S. Pat. No. 4,144,181 discloses polymer additives for fuels and lubricants comprising a grafted ethylene copolymer reacted with a polyamine, polyol or hydroxyamine and finally reacted with an alkaryl sulfonic acid.

The disclosures in the forgoing patents which relate to VI improvers and dispersants for lubricating oils, namely U.S. Pat. Nos. 3,522,180, 4,026809, 4,089,794, 4,137,185, 4,144,181, 4,146,489, 4,320,019, 4,340,689, 4,357,250, and 4,382,007 are incorporated herein by reference.

An object of this invention is to provide a novel derivatized copolymer composition.

Another object is to provide a process for preparing a derivatized copolymer with an unsaturated isocyanate to form a reactive intermediate which is then reacted with an antioxidant aromatic hindered amine.

Still another object of this invention is to provide a multi-functional lubricant additive effective for imparting viscosity index, dispersancy and anti-oxidant properties to a lubricating oil composition.

A further object is to provide a novel lubricating oil composition containing the copolymer additive of the invention as well as to provide concentrates of the novel additive of the invention.

SUMMARY OF THE INVENTION

The present invention is directed to a method of making dispersant/antioxidant VI improvers based on a polymer prepared in a two-step process which comprises using olefin copolymers as a polymer base derived with unsaturated isocyanates and hindered aromatic amines. First, unsaturated isocyanate is grafted under elevated temperatures with the addition of a free radical initiator. The grafting reaction is followed by a capping of a hindered aromatic amine.

The following reactions illustrate the process of the present invention:

1. Grafting reaction $$P + R_1R_2{-}N{=}C{=}O \xrightarrow[\text{(Free Radical Initiator)}]{} P{-}R'_1R_2{-}N{=}C{=}O \qquad \text{(I)}$$

wherein P is a polymer selected from the group consisting of ethylene propylene copolymer, ethylene propylene diene terpolymer, hydrogenated styrene-butadiene copolymer, styrene isoprene copolymer, and hydrogenated isoprene polymer; $R_1$ is an radical containing unsaturation such as methacryloyl benzyl, alkenyl or allyl; $R_2$ is an organic linear, cyclic or heterocyclic, and aromatic or heteroaromtic unit composed of hydrocarbon and/or one or more atom of oxygen, nitrogen, sulfur or phosphorus; and $R'_1$ is an unit derived from $R_1$.

2. Capping reaction

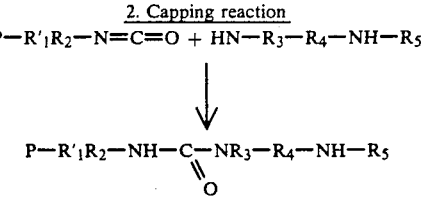

wherein P is a polymer selected from the group consisting of ethylene propylene copolymer, ethylene propylene diene terpolymer, hydrogenated styrene-butadiene copolymer, styrene isoprene copolymer, and hydrogenated polyisoprene; $R_1$, $R_2$ and $R'_1$ are as above; $R_3$ is hydrogen or an organic linear, cyclic or heterocyclic, and aromatic or heteroaromatic unit composed of hydrocarbon and/or one or more atom of oxygen, nitrogen, sulfur or phosphorus; $R_4$ is an aromatic group composed of hydrocarbon and/or one or more atoms of oxygen, nitrogen, sulfur or phosphorus; and $R_5$ is $R_2$.

The novel reaction product of the invention preferably is prepared using ethylene-propylene copolymer (EPM) or ethylene-propylene diene terpolymer (EPDM) as a polymer base, isocyanato ethyl metacrylate as a functionalizing agent and N-phenyl-p-phenylene diamine as a hindered aromatic amine.

The lubricant of the present invention comprises an oil of lubricating viscosity and an effective amount of the novel reaction product. The lubricating oil will be characterized by having viscosity index improver, dispersancy and anti-odicant properties.

Concentrates of the reaction product of the invention as well as its method of preparation are also contemplated.

DESCRIPTION OF THE INVENTION

This invention as discussed briefly above, is directed to a polymer comprising an oil-soluble, substantially linear, carbon-carbon backbone polymer bearing dispersant and antioxidant units thereon, derived from a functional monomer containing a isocyanate group and an aromatic hindered amine such as N-phenyl-p-phenylene diamine.

The charge polymer which may be employed in the practice of the present process of this invention may include an oil-soluble, substantially linear, carbon-carbon backbone polymer. Typical carbon-carbon backbone polymers , prepared from monomers bearing an ethylenically unsaturated polymerizable double bond, which may be employed include homopolymers or copolymers prepared from a monomer containing the grouping

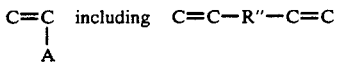

wherein A may be a hydrogen, hydrocarbon such as alkyl, aryl (particularly phenyl) etc., —OOCR typified by acetate or less preferred acyloxy (typified by —OOCR) halide, etc. R″ may be divalent hydrocarbon typified alkylene, alkarylene, cycloalkylene, arylene, etc.

Illustrative of such monomers may be acrylates, methacrylate, vinyl halides (such as vinyl chloride), styrene, olefins such as propylene, butylene, etc.; vinyl acetate; dienes such as butadiene, isoprene, hexadiene, ethylidene norbornene, etc. Homopolymers of olefins (such as polypropylene, polybutylene, etc.), dienes (such as hydrogenated polyisoprene), or copolymers of ethylene, with e.g. butylene and higher olefins, styrene, isoprene and/or butadiene may be employed.

The polymer and copolymers prepared from the above mentioned monomers having short and long branches or star shape structure may also be employed.

The preferred carbon-carbon backbone polymers include those selected from the group consisting of ethylene-propylene copolymers (EPM or EPR) and ethylene-propylene-diene terpolymers (EPDM or EPT).

When the charge polymer is an ethylene-propylene copolymer (EPM), it may be formed by copolymerization of ethylene and propylene under known conditions preferably Ziegler-Natta reaction conditions. The preferred EPM copolymers contain units derived from the ethylene in amount of 40–90 mole %, preferably 55–80 mole %, say 60 mole %, the remainder being derived from propylene.

The molecular weight $\overline{M}_n$ of the EPM copolymers which may be employed may be about 0,000 to about 1,000,000, preferably about 20,000 to about 200,000, and most preferably about 140,000. The molecular weight distribution may be characterized by $\overline{M}_w/\overline{M}_n$ of less than about 15, preferably 1.2–10, say 1.8.

Illustrative EPM copolymers which may be employed in practice of the process of this invention may be those set forth below in Table I, the first listed being preferred.

TABLE I

A. The Epsyn brand of EPM marketed by Copolymer Rubber and Chemical Corporation containing 59 mole % of units derived from ethylene and 41 mole % of units derived from propylene, having a molecular weight $\overline{M}_w$ of 140,000 and a $\overline{M}_w/\overline{M}_n$ of 1.6.

B. The Epcar 505 brand of EPM marketed by B.F. Goodrich Co., containing 50 mole % of units derived from ethylene and 50 mole % of units derived from propylene, having a $\overline{M}_n$ of 25,000 and a polydispersity index of 2.5.

C. The Esprene brand of EPR marketed by Sumitomo Chemical Co., containing 55 mole % of units derived from ethylene and 45 mole % of units derived from propylene and having a $\overline{M}_n$ of 25,000 and polydispersity index of 2.5.

When the charge polymer is ethylene-propylene-diene terpolymer (EPT or EPDM), it may be formed by copolymerization of ethylene, propylene, and diene monomers. The diene monomer is commonly a non-conjugated diene typified by dicyclopentadiene; 1.4-hexadiene; ethylidene norbornene or vinyl norbornene. Polymerization is effected under known conditions generally comparable to those employed in preparing the EPM products. The preferred terpolymers contain units derived from ethylene in amount of 40–70 mole %, preferably 50–65 mole mole %, say 60 mole % and units derived from propylene in an amount of 20–60 mole%, preferably 30–50 mole %, say 38 mole % and units derived from diene third monomer in amount of 0.5–15 mole %, preferably 1–10 mole %, say 2 mole %. The molecular weight $\overline{M}_n$ of the terpolymers may typically be about 10,000 to about 500,000, preferably about 120,000 to about 200,000, and most preferably about 120,000. Molecular weight distribution of the useful polymers is preferably narrow viz a $\overline{M}_w/\overline{M}_n$ of typically less than 10, preferably 1.5–5, say about 2.2.

Illustrative EPT terpolymers which may be employed in the practice of the present process may be those set forth below in Table II, the first listed being preferred.

TABLE II

A. The sheared Epsyn 4106 brand of EPT marketed by Copolymer Rubber and Chemical Corp., containing 59 mole % of units derived from ethylene, 40.5 mole % of units derived from propylene, and 0.5 mole % of units derived from ethylidene norbornene and having a $\overline{M}_w\overline{M}_n$ 2.2 and a molecular weight $\overline{M}_n$ of 80,000.

B. The Ortholeum 5655 brand of EPT marketed by DuPont containing 62 mole % of units derived from ethylene, 36 mole % of units derived from propylene, and 2 mole % of units derived from 1,4-hexadiene and having a $\overline{M}_n$ of 75,000 and a polydispersity index $\overline{M}_w/\overline{M}_n$ of 2.

C. The Ortholeum 2052 brand of EPT marketed by DuPont containing 62 mole % of units derived from ethylene, 36 mole % of units derived from propylene, and 2 mole % of units derived from 1,4-hexadiene and having a $\overline{M}_n$ of 35,000 and a polydispersity index $\overline{M}_w/\overline{M}_n$ of 2.

D. The Royalene brand of EPT marketed by Uniroyal containing 62 mole % of units derived from ethylene, 37 mole % of units derived from propylene, and 3 mole % of units derived from dicyclopentadiene and having a $\overline{M}_n$ of 100,000 and a polydispersity index $\overline{M}_w/\overline{M}_n$ of 2.5.

E. The sheared Epsyn 40A brand of EPT marketed by Copolymer Rubber and Chemical Corp., containing 60 mole % of units derived from ethylene, 37 mole % of units derived from propylene, and 3 mole % of units derived from ethylidene norbornene and having a of 140,000 and a polydispersity index $\overline{M}_w/\overline{M}_n$ of 2.

It is a feature of the process of this invention that the additive is prepared in two-step process. In the first step a functional monomer containing isocyanate group is grafted in the presence of a free radical initiator. In the second step, a hindered aromatic amine is reacted with the pendant isocyanate groups of the said polymer.

THE GRAFT FUNCTIONAL MONOMER

It is a feature of the process of this invention that the graft functional monomers which may be employed (within a polymeric configuration) may be characterized by the presence of units containing an ethylenically unsaturated carbon-carbon double bond and an isocyanate group. Although the graft monomer may contain more than one ethylenically unsaturated carbon-carbon double bond or isocyanate group. Ethylenically unsaturated carbon-carbon double bond or isocyanato group, in a preferred embodiment it may contain one of each. Graft monomers containing more than one ethylenically unsaturated carbon-carbon double bond are much less preferred because of the high probability of cross-linking during subsequent reaction.

In one aspect of this invention, the preferred graft functional monomer maybe characterized by the formula

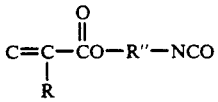

In the above formula, R″ may be a hydrocarbon group selected from the group consisting of alkylene, aralkylene, cycloalkylene, arylene, and alkarylene, including such radicals when inertly substituted. When R″ is alkylene, it may typically be methylene, ethylene, n-propylene, iso-propylene, n-butylene, i-butylene, sec-butylene, amylene, octylene, decylene, octadecylene, etc. When R″ is aralkylene, it may typically be benxylene, betaphenylethylene, etc. When R″ is cycloalkylene it may typically be cyclohexylene, cycloheptylene, cyclooctylene, 2-methylcloheptylene, 3-butylcyclohexylene, 3-methycyclohexylene, etc. When R″ is arylene, it may typically be phenylene, naphthylene, etc. When R″ is alkarylene, it may typically be tolylene, xylylene, etc. R″ may be inertly substituted i.e., it may bear a non-reactive substituent such as alkyl, aryl, cycloalky, ether, etc. Typically, inertly substituted R″ groups may include 2-ethoxyetylene, carboethoxymethylene, 4-methyl cyclohexylene, etc. The preferred R″ groups may be lower alkylene, i.e., ($C_1$–$C_{10}$) alkylene groups including, e.g., methylene ethylene, N-propylene, butylene, amylene, hexylene, octylene, decylene, etc. R″ may preferably be ethylene —$CH_2$ $CH_2$.

In the above compound, R may be a hydrocarbon selected from the group consisting of alkyl, aralkyl, cycloalkyl, aryl, and alkaryl, including such radicals when inertly substituted. When R is alkyl, it may typically be methyl, ethyl, n-propyl, iso-propyl, n-butyl, i-butyl, secbuty, amyl, octyl, decyl, octadecyl, etc. when R is aralkyl, it may typically be benzyl, beta-phenylethyl, etc. When R is cycloalkyl, it may typically be cyclohexyl, cyloheptyo, cyclooctyl, 2-methylcycloheptyl, 3-butylcyyclohexyl, 3-methylcyclohexyl, etc. When R is aryl, it may typically be phenyl, naphthyl, etc. When R is alkaryl, it may typically be tolyl, xylol, etc. R may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred R groups may be lower alkyl, i.e. $C_1$–$C_{10}$ alkyl, groups including eg methyl, ethyl, n-propyl, i-propyl, butyls, amyls, hexyls, octyls, decyls, etc. R may preferably be methyl.

The graft functional monomer may be an isocyanate of an unsaturated hydrocarbon typified by those hydrocarbons listed below in Table III:

TABLE III allyl isocyanate
buten-2-yl isocyanate
buten-3-yl isocyanate
p-isocyanato styrene
2,6-diisocyanato styrene
m-isopropenyl-a,a-dimethyl-benzyl isocyanate The functional monomer may be an isocyanate of an unsaturated acid (as acid or as ester) typified by:
4-isocyanato-butene-2-carboxylic acid The preferred graft functional monomers may be isocyanatohydrocarbyl esters of unsaturated monocarboxylic acids, typified by those esters listed below in Table IV:

TABLE IV

Isocyanatoethyl methacrylate
Isocyanatomethyl acrylate
Omegaoisocyanato-n-butyl methacrylate The preferred graft functional monomer may be isocyanatoethyl methacrylate.

It is a feature of the process of this invention that the graft functional monomers may be grafted onto carbon-carbon backbone polymers.

THE GRAFTING REACTION

In the practice of the process of this invention, 100 parts of charge EPM or EPT may be added to 100–1000 parts, say 300 parts of diluent-solvent. Typical diluent-solvent may be a hydrocarbon solvent such as mineral oil, n-hexane, n-heptane, or tetrahydrofuran. Preferred solvent may be a commercial hexane containing principally hexane isomers or a commercial mineral grafting oil. Reaction mixture may then be heated under nitrogen to reaction conditions of 60° C.–180° C., preferably 150° C.–170° C., say 155° C. When n-hexane or other low boiling solvent is used, reaction is carried out in pressure reactor at 15–300 psig, preferably 180–220 psig, say 200 psig.

Graft monomer, typically isocyanoethyl methacrylate, is admitted in amount of 1–40 parts, say 5 parts, as a solution in 0–20 parts, say 5 parts of diluent-solvent. There is also added a solution in diluent-solvent of free radical initiator. Typical free radical initiators, (graft polymerization catalysts) may include dicumyl peroxide, di-t-butyl peroxide, benzoyl peroxide, di-isopropyl peroxide, azobisisobutyronitrile, etc. The solvent is preferably the same as that in which the EPM or EPT is dissolved. The initiator may be added in amount of 0.2–40 parts, say 2 part in 2 parts. The preferred free radical initiator is a dicumyl peroxide (DICUP).

The reaction is carried out at a temperature at least as high as the decomposition temperature of the initiator, typically 60° C. or higher.

The grafting reaction is typically carried out at graft polymerization conditions of 60° C.–180° C., say 155° C. during which time bonding of the graft functional monomer onto the base EPM or EPT polymer occurs.

Typically the reaction may proceed as follows:

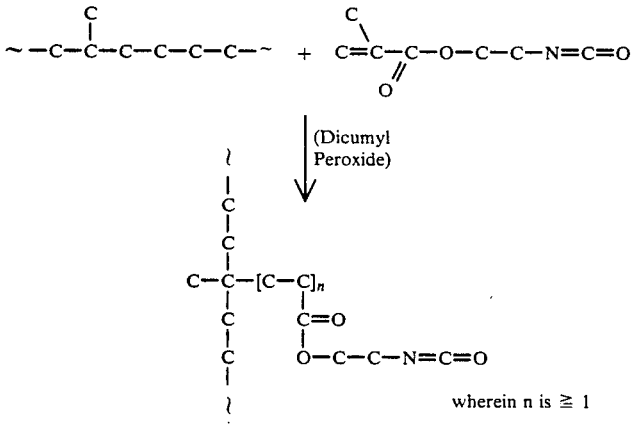

The product graft polymer may be characterized by the presence of pendant isocyanato groups -NCO bonded to the polymer backbone thorough the residue of the graft monomer, the latter being bonded to the polymer backbone through one of the carbon atoms which formed the ethylenically unsaturated double bond.

Typically the graft product polymer may by contain 0.1–20, say 0.4 units derived from graft monomer per 1000 carbon atoms of the charge backbone polymer.

THE AMINE REACTANT

In practice of the present process, the graft polymer bearing pendant isocyanate groups may be reacted with an aromatic amine containing at least one non-tertiary nitrogen atom. The amine may be characterized by the formula R* R NH. In this formula R represents hydrogen or an organic radical having from 1 to 10 carbon atoms which may contain nitrogen, oxygen or sulfur atoms. R* represents an aromatic hindered amine. It is preferred that the amine be a N-phenyl-p-phenylene diamine.

THE AMIDIZATION REACTION

Amidization may be carried out by adding the graft polymer containing isocyanate groups to a reaction vessel together with inert-diluent solvent. In the preferred embodiment, reaction may be carried out in the same solvent and in the same reaction medium as that in which the polymer is dissolved.

Typically, the reaction may proceed as follows:

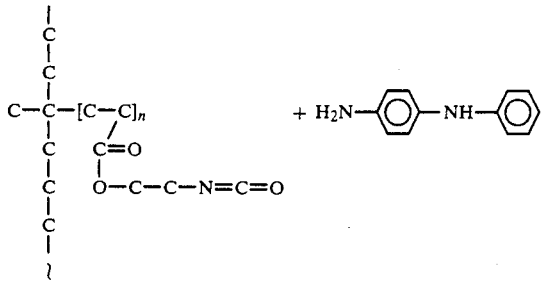

-continued

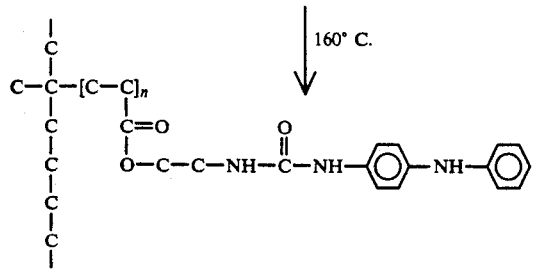

An amine, typically N-phenyl-p-phenylene diamine is added to the reaction vessel. The amount of amine added is preferably 0.1–5 moles, say 1.2 moles per mole of isocyanate group bonded to the polymer. Typically this may correspond to 0.01–0.5 moles, say -0.039 moles of amine per 100g of polymer.

The amidization reaction is carried out over 0.1–10 hours, say 2 hours at 100° C.–180° C., say 155° C. with agitation. For ease of handling, the final produced may be diluted to form a solution of 4–20 parts, say 13 parts of polymer in 80–95, say 87 parts of mineral oil such as a SUS 100 oil typified by SNO-100. When the product has been prepared in a low-boiling solvent such as hexane, the latter has to be distilled off.

The fluid solution (a lubricating additive) is used for further testing.

It is a feature of this invention that the soprepared polymer solution in oil may find use in lubricating oils as multifunctional additive (e.g. dispersant viscosity index improvers which provide anti-oxidant properties, etc.) when present in effective amount of about 1.0 to about 20 wt%, preferably 3–15 wt%, preferably about 0.9 wt%.

Lubricating oils in which the multifunctional additives of this invention may find use may include automotive, aircraft, marine, railway, etc., oils; oils used in spark ignition or compression ignition; summer or winter oils, etc. Typically the lubricating oils may be characterized by a b.p. of about 570° F. to about 660° F., preferably 610° F.; an e.p. of about 750° F. to about 1200° F., preferably 1020° F.; an an API gravity of about 25 to about 31, preferably about 29.

A typical lubricating oil in which the polymer of this invention may be present may be a standard SAE 5W-30 hydrocarbon motor oil formulation having the composition as set forth below in Table V:

TABLE V

| | Wt % |
|---|---|
| Base Oil | 82 |
| Viscosity Index Improver (additive of this invention) (10 w % ethylene-propylene copolymer in 90% inert oil) | 9 |
| Standard Additive Package: Polyisobutenyl $(M1290)_n$ succinimide (dispersant); calcium sulfonate (detergent); Zinc dithiophosphate (anti-wear); di-nonyl diphenyl amine (anti-oxidant); 4,4'-methylene-bis (2,6-di-t-butyl phenol) (antioxidant) | 9 |

Use of the additive of this invention makes it possible to readily increase the viscosity index by 25–40 units, say 35 units and to obtain improved ratings on the tests measuring the dispersancy of the system. The viscosity index is determined by ASTM Test D-445.

The present invention comprises making dispersant and antioxidant VI improvers by derivatizing hydrocarbon polymers such as ethylene-propylene copolymer (EPM), or ethylene-propylene-diene terpolymer (EPDM) with, e.g., isocyanate ethyl methacryate and a hindered aromatic amine such as N-phenyl-p-phenylene diamine.

Addition of the above invention additives, to a lubricating oil, may be facilitated by use of a concentrate containing about 1 to about 20 wt.%, preferably about 4 to about 14 wt% of polymer.

The tests and analysis used, according to the present invention, are provided below.

TESTS AND ANALYSIS

1. Oxidation Stability

The antioxidant activity of the new antioxidant and dispersant VI improver was examined by a proprietary test called Bench Oxidation Test (BOT). In this test, the polymer solution is diluted with SNO-130 oil. The mixture is heated with stirring and air agitation. Samples are withdrawn periodically for analysis, by differential infrared analysis (DIR), to observe changes in the intensity of the carbonyl vibration band at $C_{-1}$. Higher carbonyl group intensity indicates a lower thermal oxidative stability of the sample. The result reported, as oxidation index, indicates the change in the intensity of the carbonyl vibration band at $C^{-1}$ after 144 hours of oxidation. A lower rating indicates better thermal oxidative stability of the mixture.

2. Dispersancy

The sample is blended into a formulated oil, not containing a dispersant, to form 0.9 wt.% polymer solution. That blend is tested for dispersancy in the Bench VC Test. In this test, the turbidity of an oil containing an additive is measured after heating the test oil to which has been added a standard blow-by. The result correlates with dispersancy and is compared to three standards (Good, Fair, and Poor) tested simultaneously with the test sample. The numerical rating decreases with an increase in dispersant effectiveness. Results above 90 indicate that the additive does not provide dispersant activity.

The grafting yield of a grafted monomer is usually determined by IR-analysis of isolated rubber. Changes in the aromatic band at 1600 CM-1 compared to the ungrafted rubber band at 722 cm-1 are examined. The rubber is isolated from solution by multiple dissolvation/precipitation using cyclohexane as a solvent and acetone as precipitator. Then the rubber is dried in vacuum at 60° C. for 36 hours.

DESCRIPTION OF THE PREFERRED EMBODIMENTS

The practice of the process of this invention will be more apparent to those skilled in the art from the following examples wherein, as elsewhere in this specification, all parts are parts by weight unless otherwise set forth. Control examples are designated by an asterisk.

EXAMPLE 1

In this example an OCP is modified by grafting isocyanato ethyl methacrylate (IEM) and capping N-phenyl-p-phenylenediamine (NPPDA).

The isocyanato ethylmethacrylate is grafted onto EPM containing around 0.3 mole% of ethylidene norbornene (extruded EPsyn 4106) in presence of free radical initiator, dicumyl peroxide. EPM (Mn=80,000 as measured by SEC) containing approximately 60 mol% of ethylene is used.

100 wt parts of EPM dissolved in 400 parts of mineral grafting oil (SUN-148) is heated to 155° C. (with stirring under nitrogen). 6.0 w parts of IEM is added followed by 2.2 wt parts dicumyl peroxide dissolved in 9 wt parts of oil. The mixture is stirred using above conditions for 2 hours.

7.12 wt parts of NPPDA dissolved in ml Surfonic N-40 is added and the mixture is stirred at room temperature for 2 hours.

Then, the solvent neutral oil (SNO-100) is added to give a solution containing 13.0 wt% polymer. This solution is used for further testing.

EXAMPLE 2

In this example an OCP is modified by grafting m-isopropenyl-a,a-dimethyl-benzyl isocyanate (TMI) and capping N-phenyl-p-phenylenediamine (NPPDA).

The procedure of example 1 is followed except that 11.9 wt parts of TMI instead of 6.0 wt parts of IEM and 10.7 wt parts of NPPDA and 3.50 wt parts of DICUP is used.

EXAMPLE 3*

In this example, 12.5 wt% EPM solution in mineral oil is prepared. 100 wt parts of EPM which is used in the example 1, is added to 400 wt parts of SUN-148 and 300 wt parts of SNO-100. The mixture is heated to 155° C. with stirring and under nitrogen for 3 hours until the rubber is completely dissolved.

RESULTS

The evaluation data for the samples of Examples 1,2 and 3* are listed below in Table VI. The sample numbers are related to the example numbers.

As seen in the Table VI samples of Examples 1 and 2 containing rubber grafted with monomers of Examples 1 and 2, respectively, show good antioxidant activity. The sample 1 shows also the excellent dispersant activity. The reference sample of Example 3* containing unmodified rubber show neither dispersant activity nor antioxidant stability.

TABLE VI

| PROPERTIES OF VI IMPROVERS | | | |
|---|---|---|---|
| SAMPLE | 1 | 2 | 3* |
| MATERIAL WT PARTS | | | |
| EPM | 100 | 100 | 100 |
| IEM | 6.0 | — | — |
| TMI | — | 11.9 | — |
| NPPDA | 7.12 | 10.7 | — |
| DICUP | 2.19 | 3.50 | — |
| Grafting Oil | 331.8 | 331.8 | 331.8 |
| Diluent Oil | 324.7 | 313.9 | 337.4 |
| OXIDATION INDEX (1) | 1.0 | 1.0 | 19.0 |
| BENCH DISPERSANCY (2) | | | |
| RESULTS | 39 | 93 | 92 |
| STANDARDS | | 28/30/56 | |

(1) Change in the intensity of the carbonyl group IR vibration at 1710 $cm^{-1}$ after 144 hours in Bench Oxidation Test.
(2) As measured by Bench VC Test

We claim:

1. A method of preparing a substantially linear polymer composition containing a carbon-carbon backbone which comprises: forming a reaction mixture at a temperature of 100–180° C. for 0.1–10 hours containing a substantially liner, carbon-carbon backbone polymer which is a copolymer of ethylene-propylene or a terpolymer of ethylene-propylene-diene; graft polymerizing or a terpolymer of ethylene-propylene-diene; graft polymerizing onto said substantially linear carbon-carbon backbone polymer, under graft polymerization reaction conditions in the presence of free radical initiator, a graft monomer containing an ethylenically unsaturated carbon-carbon double bond which is allyl isocyanate, buten-2-yl isocyanate, buten-3-yl isocyanate, p-isocyanate styrene, or 2,6-diisocyanato tyrene, or m-isoprenyl-a-, a-dimethyl benzylisocyanate; and an isocyanate group thereby forming a graft polymer bearing a pendant isocyanate group; amidizing said graft polymer bearing a pendant isocyanate group with an aromatic hindered amine containing a non-tertiary amino nitrogen atom thereby converting said isocyanate group to a urea group pendant on said polymer composition and forming a graft polymer containing a pendant urea group; and recovering said graft polymer containing said urea group with an hindered aromatic amine.

2. A method of preparing a substantially linear polymer composition containing a carbon-carbon backbone which comprises: forming a reaction mixture at 100° -180° C. containing, as backbone polymer, a copolymer of ethylene-propylene or a terpolymer of ethylene-propylene-diene; graft polymerizing onto said backbone polymer, under graft polymerization reaction conditions in the presence of free radical initiator a graft monomer isocyanatoethyl methacrylate thereby forming a graft polymer bearing pendant isocyanate groups; amidizing said graft polymer bearing pendant isocyanate groups with N-phenyl-p-phenylenediamine thereby converting said isocyanate groups to urea groups and forming a graft polymer containing pendant urea groups; and recovering said graft polymer containing urea groups with n-phenyl-phenylene diamine.

3. A substantially linear graft polymer containing a carboncarbon backbone which comprises a substantially linear carboncarbon backbone polymer and graft polymerized thereon, under graft polymerization reaction conditions of 100° C. -180° C. in the presence of free radical initiator graft monomer containing an ethylenically unsaturated carbon-carbon double bond and an isocyanate group which has been amidized by reaction with an aromatic hindered amine containing a non-tertiary amino nitrogen atom.

4. A substantially linear graft polymer containing a carboncarbon backbone as claimed in claim 3 wherein said backbone polymer is a copolymer of ethylene-propylene or an ethylene-propylene-diene terpolymer.

5. A substantially linear graft polymer containing a carboncarbon backbone as claimed in claim 3 wherein said graft monomer contains the grouping

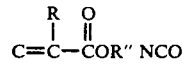

wherein R is hydrogen or an alkyl, alkaryl, aralkyl, cycloalkyl, or aryl hydrocarbon group and R'' is an alkylene, aralkylene, alkarylene, cycloalkylene, or arylene hydrocarbon group.

6. A substantially linear graft polymer containing a carbon-carbon backbone as claimed in claim 3 wherein said graft monomer is isocyanatoethyl methacrylate.

7. A substantially linear graft polymer containing a carbon-carbon backbone as claimed in claim 3 wherein said amine is an aromatic hindered amine.

8. The substantially linear graft polymer containing a carbon-carbon backbone as claimed in claim 3 wherein said amine is N-phenyl-p-phenylenediamine.

9. A lubricating oil composition comprising a major portion of lubricating oil and a minor effective viscosity index improving portion of a substantially linear graft polymer containing a substantially linear carbon-carbon backbone polymer and graft polymerized thereon, under graft polymerization reaction conditions of 100° C. -180° C. in the presence of free radical initiator, graft monomer containing an etylenically unsaturated carbon-carbon double bond and an isocyanate group said isocyanate group, after graft polymerization has been effected, having been amidized by reaction with an aromatic hindered amine containing a non-tertiary amino nitrogen atom.

10. The lubricating oil composition as claimed in claim 9 wherein said backbone polymer is a copolymer of ethylene-propylene or a terpolymer of ethylene-propylene-diene.

11. The lubricating oil composition as claimed in claim 9 wherein said graft monomer contains the grouping

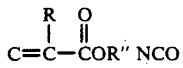

wherein R is hydrogen or an alkyl, alkaryl, aralkyl, cycloalkyl, or aryl hydrocarbon group and R″ is an alkylene, aralkylene, alkarylene, cycloalkylene, or arylene hydrocarbon group.

12. The lubricating oil composition as claimed in claim 9 wherein said graft monomer is isocyanatoethyl methacrylate.

13. The lubricating oil composition as claimed in claim 9 wherein said graft monomer is allyl isocyanate, buten-2-yl isocyanate, buten-3-yl isocyanate, p-isocyanato styrene, or 2,6-diisocyanato styrene.

14. The lubricating oil composition as claimed in claim 9 wherein said amine is R*RNH wherein R is hydrogen or alkyl, alkaryl, aralkyl, cycloalkyl, or aryl and R* is an aromatic hindered amine.

15. The lubricating oil composition comprising as claimed in claim 9 wherein said amine is a amine is N-phenyl-p-phenylenediamine.

16. A lubricating oil composition as claimed in claim 7 wherein said minor effective viscosity index improving portion is 0.2–20 wt%.

* * * * *